US008377230B2

(12) United States Patent
Hartmann et al.

(10) Patent No.: US 8,377,230 B2
(45) Date of Patent: Feb. 19, 2013

(54) HOUSEHOLD APPLIANCE COMPRISING A LOCKING DEVICE

(75) Inventors: Michael Hartmann, Höchstädt (DE); Dieter Hotz, Dischingen-Eglingen (DE); Cengiz Kücük, Syrgenstein (DE); Bernd Schessl, Dillingen/Donau (DE); Erich Schmid, Sontheim a.d.Brenz (DE); Martin Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1154 days.

(21) Appl. No.: 11/918,823

(22) PCT Filed: Apr. 13, 2006

(86) PCT No.: PCT/EP2006/061583

§ 371 (c)(1),
(2), (4) Date: Oct. 17, 2007

(87) PCT Pub. No.: WO2006/111504

PCT Pub. Date: Oct. 26, 2006

(65) Prior Publication Data

US 2009/0072550 A1 Mar. 19, 2009

(30) Foreign Application Priority Data

Apr. 19, 2005 (DE) ..... 10 2005 017 871

(51) Int. Cl.
*B08B 3/00* (2006.01)

(52) U.S. Cl. ..... 134/57 DL; 134/56 D; 134/57 D; 134/58 D; 134/58 DL

(58) Field of Classification Search ..... 134/57 DL, 134/58 DL, 56 D, 57 D, 58 D
See application file for complete search history.

(56) References Cited

U.S. PATENT DOCUMENTS

| | | | |
|---|---|---|---|
| 3,997,201 | A | 12/1976 | DeSchaaf et al. |
| 4,776,620 | A | 10/1988 | Marks et al. |
| 5,484,175 | A | 1/1996 | Teich et al. |

FOREIGN PATENT DOCUMENTS

| | | |
|---|---|---|
| DE | 1997310 | 11/1968 |
| DE | 2 106 272 | 8/1972 |
| DE | 31 19 764 | 12/1982 |

(Continued)

OTHER PUBLICATIONS

EP 1 388 604 English Translation Feb. 2004 Harrer et al.*

(Continued)

*Primary Examiner* — Michael Barr
*Assistant Examiner* — Charles W Kling
(74) *Attorney, Agent, or Firm* — James E. Howard; Andre Pallapies

(57) ABSTRACT

The invention relates to a domestic appliance having a device for locking a movable closing element, especially a door, cover, flap, or similar on a household appliance, particularly a dishwasher. The locking device includes a closing hook or closing pin disposed on the housing of the household appliance that engages with an engaging section in the closing element during locking and can be made to disengage therefrom during unlocking. The engaging section is formed by a cavity in the closing element.

19 Claims, 4 Drawing Sheets

FOREIGN PATENT DOCUMENTS

| | | | | |
|---|---|---|---|---|
| DE | 203 20 530 | | * | 8/2003 |
| DE | 203 20 530 | U | | 12/2004 |
| EP | 0 728 438 | | | 8/1996 |
| EP | 0728438 | A1 | | 8/1996 |
| EP | 728438 | A1 | * | 8/1996 |
| EP | 1388604 | A1 | * | 2/2004 |
| IT | EP 0 728 438 | | * | 8/1996 |
| JP | 99965 | | | 7/1934 |
| JP | 46005040 | Y1 | | 2/1971 |
| JP | 52002199 | U | | 1/1977 |
| JP | 5535402 | | | 8/1980 |
| JP | 5929099 | | | 8/1984 |
| JP | 59-148753 | U | | 10/1984 |
| JP | 59192171 | A | | 10/1984 |
| JP | 61052059 | U | | 4/1986 |
| JP | 5202663 | A | | 8/1993 |
| JP | 7040938 | A | | 2/1995 |
| JP | 10058974 | A | | 3/1998 |
| JP | 10131589 | A | | 5/1998 |
| JP | 10288369 | A | | 10/1998 |
| JP | 11042878 | A | | 2/1999 |
| SU | 1565479 | A1 | | 5/1990 |
| SU | 1588418 | A1 | | 8/1990 |
| SU | 1760064 | A1 | | 9/1992 |

OTHER PUBLICATIONS

International Search Report PCT/EP2006/061583.
Report of Examination JP 2008 507062 dated Jun. 2, 2011.
Report of Examination JP 2008 507062 dated Aug. 22, 2012.

* cited by examiner

HOUSEHOLD APPLIANCE COMPRISING A LOCKING DEVICE

The present invention relates to a domestic appliance, in particular a dishwasher, with a device for locking a movable closing element, in particular a door, cover, flap or similar, with a closing hook or closing stem disposed on the housing and/or frame and/or wash container of the domestic appliance, said closing hook or closing stem being able to be made to engage with an engaging section in the closing element to close a treatment compartment and being able to be made to disengage to open the treatment compartment.

A number of devices for locking closing elements on housings of domestic appliances are known from the prior art.

The publication DE 203 20 530 U1 shows a locking device for an appliance door, wherein a rotary closing unit on the appliance engages in an engaging section on the appliance door in the locking position. The engaging section is formed by a groove of rectangular cross-section, which runs along the entire upper side of the appliance door.

The publication EP 0 728 438 B1 shows a locking device for a dishwasher, with a recess provided in the upper side of the door of the dishwasher, in which a stud is disposed. In the locking position a collar element, which extends downward and is disposed in the housing of the dishwasher, engages in the recess. The collar element opens downward and a pin element projects therefrom, the front end of which rests on the stud of the recess in the locking position. When the door moves into the locking position, the pin is raised, causing a micro-switch to be activated.

The publication DE 2 106 272 shows a locking device for washing machines and spin dryers, with a lock provided in the housing of the washing machine engaging in a corresponding latching unit in the door when the door of the machine is closed.

The publication DE 31 19 764 A1 shows a dishwasher, wherein a locking bolt engages from above in an opening on the front face of the door when the machine door is in the closed state.

The publication JP 59-148753 shows a domestic appliance with a hinged door, with a groove provided on the front end of a bar engaging in a corresponding projection on the front face of the door when the door is in the closed state.

The publications U.S. Pat. No. 4,776,620 and U.S. Pat. No. 3,997,201 show locking devices for doors of domestic appliances, with a closing bolt in the door engaging in a closing plate on the housing in the locking position.

The locking devices known from the prior art have the particular disadvantage that they are expensive to produce and some of them are complex in structure.

The object of the invention is therefore to create a domestic appliance with a locking device, which is simpler to realize than the domestic appliances with locking devices known from the prior art.

In an inventive domestic appliance, in particular a dishwasher, with a device for locking a movable closing element, in particular a door, cover, flap or similar, with a closing hook or closing stem disposed on the housing and/or frame and/or wash container of the domestic appliance, said closing hook or closing stem being able to be made to engage with an engaging section in the closing element to close a treatment compartment and being able to be made to disengage to open the treatment compartment, the engaging section is molded in the closing element.

The engaging section is preferably formed by a cavity in the closing element.

In a preferred embodiment the engaging section is disposed on a side of the closing element, in particular of a door. The sides are preferably the side plates of the door of the domestic appliance, in particular of the inner door of the dishwasher. In the case of dishwashers the door is preferably made up of an inner door and an outer door.

The engaging section is preferably disposed on an upper side of the closing element.

The engaging section is preferably disposed on a side opposite the axis of rotation of the closing element.

In particular the engaging section is disposed in the side in the center of the longitudinal extension of the side.

The engaging section is preferably formed by a cavity in the closing element.

Cavities are configurations of recesses that are simple to manufacture and thus allow simple production of the engaging section of the locking element. A cavity in particular refers to a depression with a closed periphery when viewed from above the cavity. The cavity also has no opening or hole to the inside of the closing element.

The cavity is preferably configured here as an integral part of the closing element, in particular being molded in the closing element. This allows the cavity to be configured in the closing element by means of a simple method step, with a corresponding molding tool being displaced into the closing element.

In a particularly preferred embodiment the closing element is formed by a hinged and/or displaceable door, in particular by an inner door, with the door being provided to close the inner compartment of the housing of the domestic appliance, which is accessible by way of an opening. Inner door here refers to a component provided on the inside of the door, which faces the inner compartment of the domestic appliance when the door is closed. The inner door is in particular a sheet metal component, with the cavity being configured, in particular molded, into the front face of the sheet metal component for example. When the cavity is provided on the upper side of the door, the closing hook or closing stem is preferably integrated in the top of the housing of the domestic appliance, to ensure a simple interaction between closing hook and cavity as a result.

The interaction of the closing hook or closing stem with the cavity is preferably such that during locking the closing hook or closing stem moves into the cavity in an essentially perpendicular manner to the opening plane. This ensures fast and reliable engagement of the hook in the cavity during closing.

In a further refinement of the inventive locking device the cavity has an essentially rectangular edge when viewed from above, with the edge preferably having rounded corners and/or sides. This minimizes the risk of injury to a user of the domestic appliance, as there are no sharp edges on the cavity.

In a further refinement the cavity has a form such that it tapers toward its lowest point. In this instance the cavity in particular has a first section running down steeply toward its lowest point and a second section opposite the first section running flat toward its lowest point. Such a shape allows the cavity to be manufactured simply and quickly and in particular ensures that it is possible to mold the cavity in the closing element. When the closing element is in the locked state, the first steep section preferably forms a stop for the closing hook or closing stem, to prevent the closing element opening. Its steepness effectively prevents the closing hook moving out of the cavity.

In a preferred refinement of the invention the first section runs at an angle between 80 and 90 degrees, in particular at an angle of essentially 85 degrees, to the opening plane of the cavity. In contrast in a preferred embodiment the second, flat section runs at an angle of 45 degrees or less, preferably at an angle between 10 and 30 degrees and particularly preferably at an angle of essentially 20 degrees, to the opening plane of the cavity.

In a further preferred refinement the first and/or second sections are configured as essentially trapezoidal. The first and/or second sections also preferably adjoin rounded sections in the peripheral direction within the cavity. These shapes are particularly suitable for producing the cavity by molding.

The engaging section, in particular the cavity, is preferably configured as a single piece with the door, in particular the inner or outer door.

Exemplary embodiments of the invention are described in detail below with reference to the accompanying figures, in which.

Figure 1:
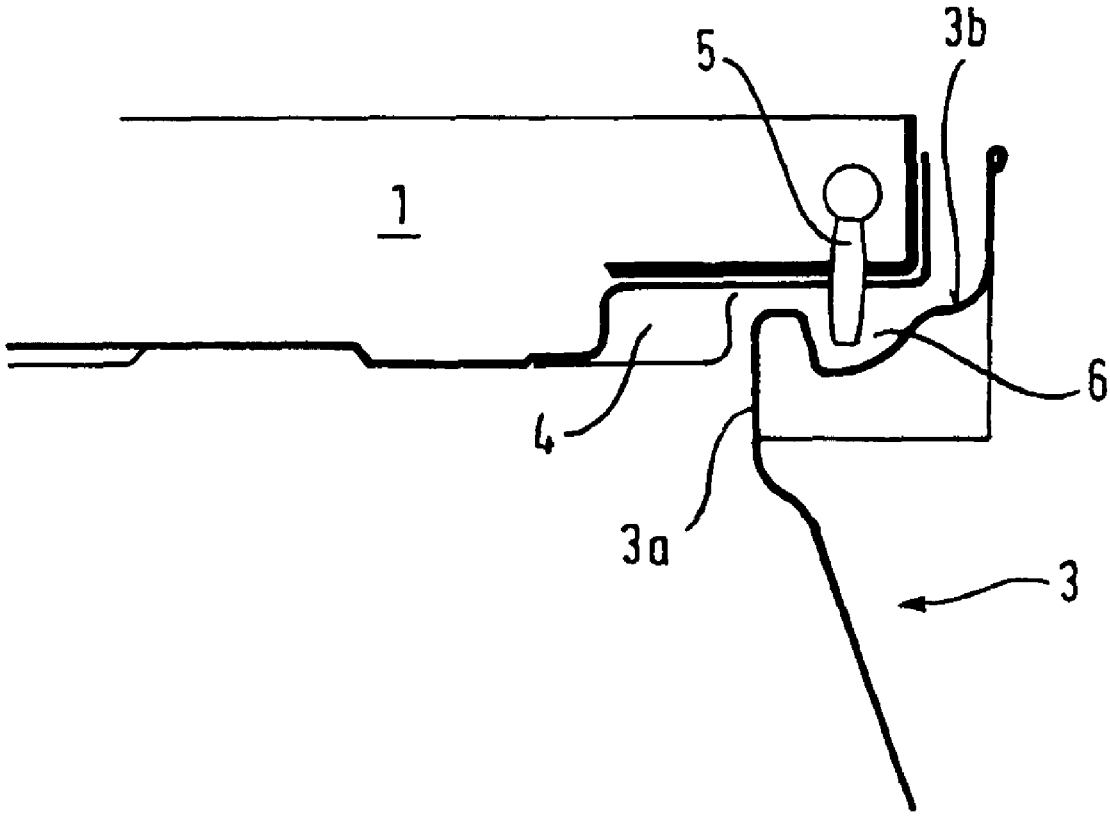
FIG. 1 shows a schematic sectional view of an embodiment of the locking device.

FIG. 1 shows a schematic sectional view of an embodiment of the locking device in an inventive domestic appliance (not shown), which is used on its housing to lock the housing door of an inventive dishwasher (not shown). In FIG. 1 the top of the container of a dishwasher is indicated with the reference character 1, with dishes to be washed positioned in the inner compartment 2 of the dishwasher. The access opening to the inner compartment 2 is sealed by way of a hinged door 3, which has an inner door 3*a*, which is formed by a molded metal sheet on the inside of the door 3. A seal 4 is shown schematically on the underside of the top of the container, said seal 4 being configured to run along the edge of the access opening to the inner compartment and serving as a seal between the inner door 3*a* and the housing 1.

To prevent inadvertent opening of the door during operation of the dishwasher, the dishwasher has a locking device, which is formed by a closing pin or closing stem 5 and a corresponding cavity 6 on the front face or upper side 3*b* of the door. The closing hook 5 is integrated in a lock housing within the top of the container and engages in the cavity 6 in the inner door 3*a* in the locked state. The closing pin, stem or hook 5 is mounted to the top of the container at a position in general vertical alignment with the cavity 6, such alignment occurring when the inner door 3*a* is closed in the locked state, as seen in FIG. 1. The closing hook 5 is only shown schematically and any form is possible for the hook. The hook is preferably spring-loaded, with the spring force pushing the hook in a downward direction.

With the locking devices typically used in dishwashers the closing hook is typically located in the inner door behind an opening. A corresponding closing plate on the housing engages in this opening when the door is closed, whereupon the closing hook drops into a hole in the closing plate and brings about the locking action. This requires on the one hand a space for the closing hook mechanism behind the panel of the door and on the other hand an opening must be provided in the inner door, which can lead to the penetration of water into the inner compartment of the door during operation of the inventive dishwasher. In contrast to this, with the locking device the closing hook is disposed in the housing and/or frame and/or wash container and interacts with a cavity for receiving the hook, so that there is no need for an opening in the inner door and space does not have to be provided for the closing hook in the inner door. This prevents the penetration of water into the inner compartment of the door and also creates structural space in the inner door, since the lock with closing hook is now integrated in available structural space in the housing. The structural space thus made available in the inner door can now be used effectively for other components, for example for a switch and control system for the dishwasher.

Figure 2:
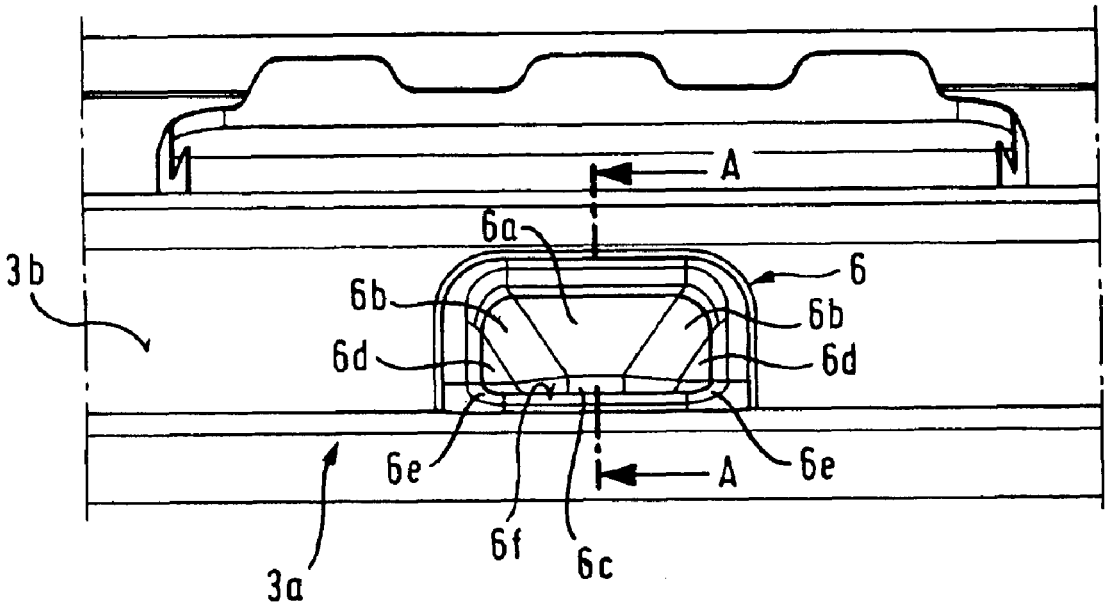
FIG. 2 shows a top view of a segment of the front face or side of the inner door of an inventive dishwasher with cavity.

FIG. 2 shows a top view of the front face 3*b* of the inner door 3*a* shown in FIG. 1. The precise form of the cavity 6 can be seen in particular in FIG. 2. The cavity is disposed in the longitudinal direction of the front face in the center between the left and right ends (not shown) of the front face. It can be seen in particular from FIG. 2 that in its opening plane the cavity is configured as essentially rectangular, with the corners and sides in the opening plane being correspondingly rounded. One important aspect of the cavity shown in FIG. 2 is that the cavity is an integral part of the inner door, in other words the cavity is molded into the inner door using a corresponding tool.

The cavity 6 comprises a trapezoidal section 6*a*, which is relatively flat in relation to the opening plane, with which a rounded section 6*b* adjoins to the right and left respectively in the peripheral direction of the cavity. The trapezoidal section 6*a* tapers toward the lowest point 6*c* of the cavity and the rounded sections 6*b* extend respectively from a corner of the rectangular edge of the cavity obliquely downward also toward the lowest point 6*c* of the cavity. There are then two essentially triangular sections 6*d* to the left and right of the rounded sections 6*b* respectively and these in turn open into corresponding rounded sections 6*e*. A relatively steeply sloping section 6*f* ultimately adjoins these sections 6*e*, lying opposite the flat section 6*a*. This steeply sloping section 6*f* serves as a stop for the closing hook when the door is in the locking position; in other words the closing hook pushes against this stop if anyone attempts to open the door when the door is locked.

Figure 3:
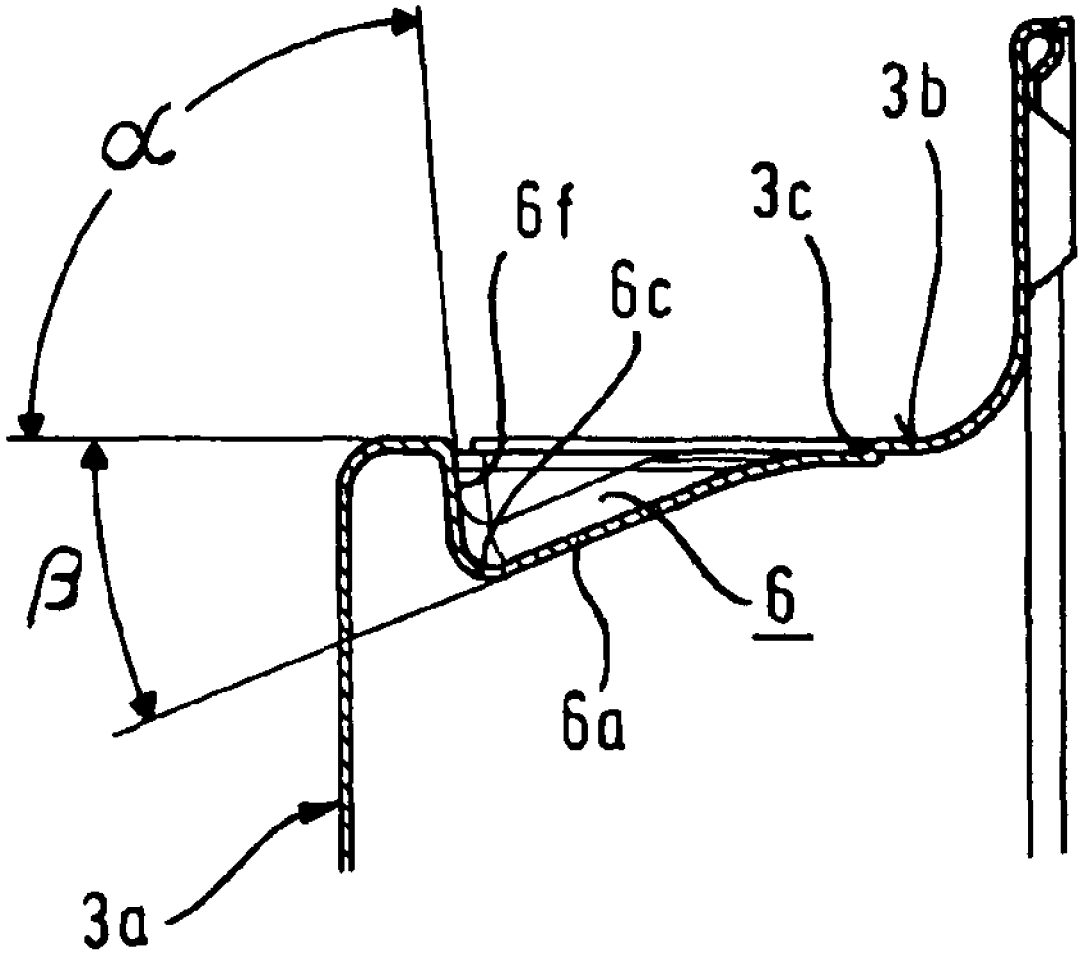
FIG. 3 shows a sectional view along the line A-A in FIG. 2.

FIG. 3 shows a sectional view along the along the line A-A in FIG. 2. It shows the orientation of the flat section 6*a* and the steep section 6*f* particularly clearly. In particular it shows that the flat section extends at an angle $\beta$ downward from the opening plane. In the embodiment in FIG. 3 the angle $\beta$ is essentially 20 degrees. However any other angle sizes are also possible. However the angle $\beta$ should be smaller than 45 degrees and preferably between 10 and 30 degrees. It is also clear from FIG. 3 that the second section 6*f* extends relatively steeply and almost perpendicular to the opening plane, at an angle $\alpha$ to the opening plane. In the embodiment in FIG. 3 the angle $\alpha$ is 85 degrees. However other angles are also possible. In particular the angle $\alpha$ should be between 80 degrees and 90 degrees.

In the embodiment shown in FIG. 3 a chamfer 3*c* is also configured on the front face 3*b* of the inner door 3*a*, adjacent to the edge of the cavity 6 in the region of the flat section 6*a*. FIG. 3 also clearly shows that the cavity 6 is an integral part of the metal sheet of the inner door, with the cavity being produced by means of a corresponding molding tool. This considerably simplifies manufacture of the cavity, since a separate component does not have to be provided for the cavity and have to be integrated in a further manufacturing step. Also there is not the problem of having to seal the cavity in relation to the inner door by means of corresponding seals.

Figure 4:
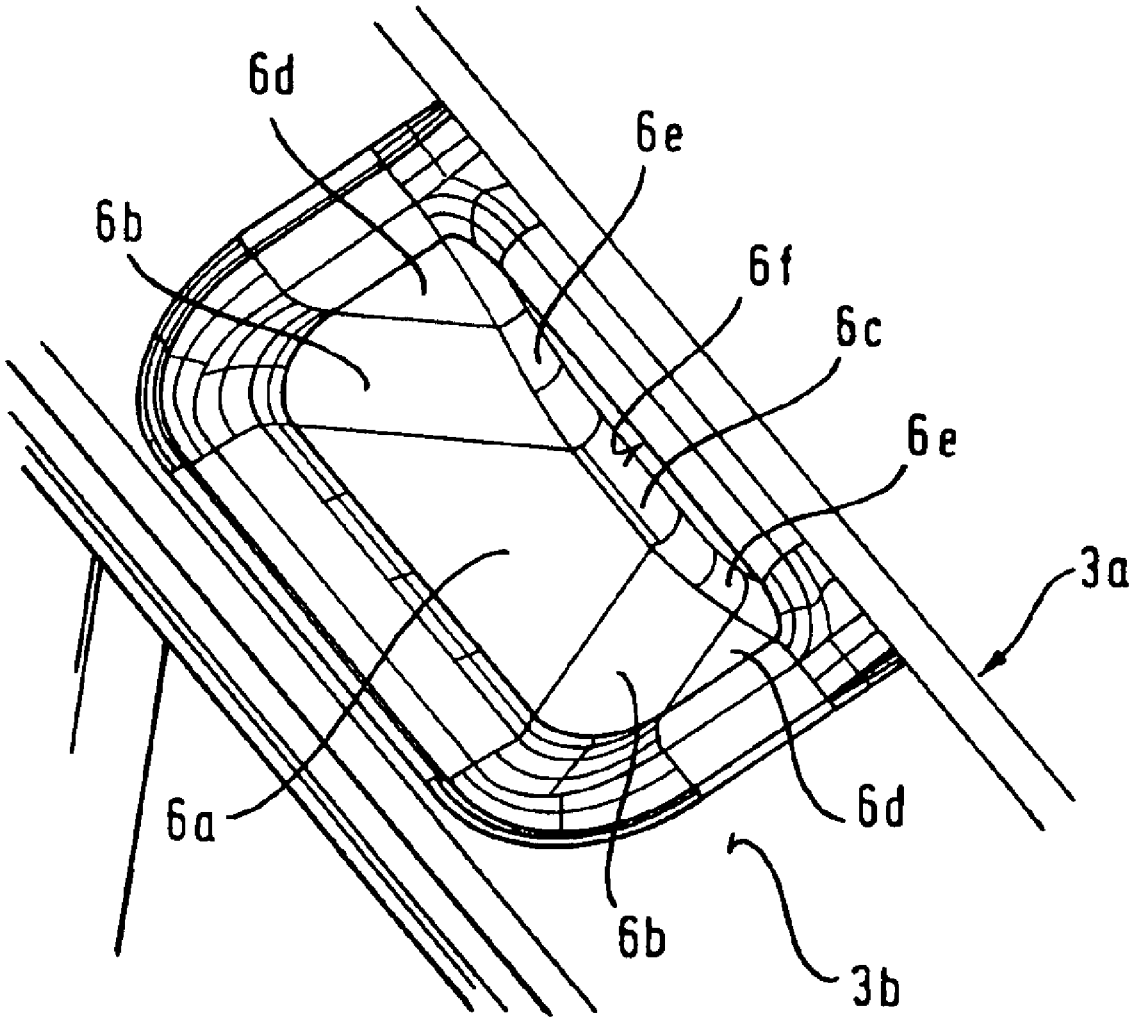
FIG. 4 shows a perspective view of the cavity shown in FIG. 2.

FIG. 4 shows a further perspective view of the cavity shown in FIG. 2. This view again shows the trapezoidal form of the flat section 6*a* very clearly. It is also clear that the edge of the cavity is rounded and that in the cavity the individual sections open into each other by way of rounded sections. The cavity therefore has no edges, thereby minimizing the risk of injury when operating the locking device.

LIST OF REFERENCE CHARACTERS

1 Top of housing
2 Inner compartment
3 Door
3*a* Inner door
3*b* Upper side
3*c* Chamfer
4 Seal
5 Closing hook
6 Cavity
6*a* Flat section
6*b* Rounded sections
6*c* Lowest point of cavity
6*d* Triangular sections
6*e* Rounded sections
6*f* Steep section
α, β Angles

The invention claimed is:

1. A domestic appliance comprising:

a.) a container defining a top and a treatment compartment for receiving therein an item to be handled by the domestic appliance, the treatment compartment especially being in the form of a treatment compartment of a dishwasher;

b.) means forming an access opening through which access can be had to an item received by the treatment compartment;

c.) an access blocking element, the access blocking element having a closure engagement section, the closure engagement section having a first section extending downwardly toward its lowest point and a second section opposite the first section extending downwardly toward its lowest point, and wherein at least one of the first section and the second section adjoins rounded sections in the peripheral direction within the closure engagement section; and d.) a closing member selectively engageable with, and disengageable from, the closure engagement section of the access blocking element, the closing member being engageable with the closure engagement section of the access blocking element in connection with a movement of the access blocking element into a closing position in which the access blocking element, operating especially as a door, a cover, a flap, or similar access opening access blocking element, closes off the access opening of the treatment compartment, and the closing member being disengageable from the closure engagement section of the access blocking element to permit a movement of the access blocking element into an opening position in which the access blocking element permits access via the access opening into the treatment compartment, and the closure engagement section of the access blocking element being molded into the access blocking element, the closing member being mounted to the top of the container at a position in general vertical alignment with the closure engagement section when the access blocking element is in the closing position.

2. The domestic appliance as claimed in claim 1, wherein the closure engagement section is formed by a cavity in the access blocking element.

3. The domestic appliance as claimed in claim 1, wherein the closure engagement section is disposed on a side of the access blocking element, in particular, a side of a door.

4. The domestic appliance as claimed in claim 3, wherein the closure engagement section is disposed on an upper side of the access blocking element.

5. The domestic appliance as claimed in claim 3, wherein the closure engagement section is disposed on a side opposite an axis of rotation of the access blocking element.

6. The domestic appliance as claimed in claim 5, wherein the closure engagement section is disposed in the side opposite the axis of rotation in a center of the longitudinal extension of the side.

7. The domestic appliance as claimed in claim 1, wherein the access blocking element is a selected one of a hinged door and a displaceable door, in particular an inner door, for closing the treatment compartment.

8. The domestic appliance as claimed in claim 1, wherein the closing member is disposed in a top of a housing of the domestic appliance.

9. The domestic appliance as claimed in claim 1, wherein the closing member interacts with the closure engagement section of the access blocking element in such that, during locking, the closing member moves into the closure engagement section of the access blocking element in an essentially perpendicular manner to an opening plane.

10. The domestic appliance as claimed in claim 1, wherein the closure engagement section of the access blocking element has a shaped edge when viewed from above.

11. The domestic appliance as claimed in claim 10, wherein the edge has at least one of rounded corners and rounded sides.

12. The domestic appliance as claimed in claim 1, wherein the closure engagement section of the access blocking element tapers toward its lowest point.

13. The domestic appliance as claimed in claim 1, wherein the first section extends downward steeply toward its lowest point and the second section extends downward less steeply than the first section toward its lowest point.

14. The domestic appliance as claimed in claim 13, wherein, when the access blocking element is in the locked state, the first section forms a stop for the closing member to prevent opening of the access blocking element.

15. The domestic appliance as claimed in claim 13, wherein the first section runs at an angle between 80 and 90 degrees, in particular at an angle of essentially 85 degrees, to an opening plane of the closure engagement section of the access blocking element.

16. The domestic appliance as claimed in claim 13, wherein the second section runs at an angle of 45 degrees or less, preferably at an angle between 10 and 30 degrees and particularly preferably at an angle of essentially 20 degrees to an opening plane of the closure engagement section of the access blocking element.

17. The domestic appliance as claimed in claim 13, wherein at least one of the first section and the second section is trapezoidal in shape.

18. The domestic appliance as claimed in claim 1, wherein the closure engagement section of the access blocking element, is formed in a unitary manner with an inner surface of a door.

19. The domestic appliance as claimed in claim 1 wherein the closure engagement section includes a chamfered surface at a junction thereof with an inner surface of the access blocking element.

* * * * *

UNITED STATES PATENT AND TRADEMARK OFFICE

CERTIFICATE OF CORRECTION

PATENT NO. : 8,377,230 B2
APPLICATION NO. : 11/918823
DATED : February 19, 2013
INVENTOR(S) : Hartmann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1299 days.

Signed and Sealed this
First Day of September, 2015

Michelle K. Lee

Michelle K. Lee
*Director of the United States Patent and Trademark Office*